US010132229B2

(12) United States Patent
Grava et al.

(10) Patent No.: US 10,132,229 B2
(45) Date of Patent: Nov. 20, 2018

(54) EXPANSION TANK FOR A MOTOR-VEHICLE COOLING SYSTEM

(71) Applicant: FCA Italy S.p.A., Turin (IT)

(72) Inventors: Giorgio Grava, Turin (IT); Maurizio Giani, Turin (IT); Salvatore Danise, Turin (IT); Marco Colantoni, Turin (IT); Giacinto Giai Gischia, Turin (IT); Davide Balestro, Turin (IT)

(73) Assignee: FCA Italy S.p.A., Turin (IT)

( * ) Notice: Subject to any disclaimer, the term of this patent is extended or adjusted under 35 U.S.C. 154(b) by 50 days.

(21) Appl. No.: 15/472,390

(22) Filed: Mar. 29, 2017

(65) Prior Publication Data

US 2017/0284280 A1 Oct. 5, 2017

(30) Foreign Application Priority Data

Mar. 30, 2016 (EP) ..... 16162753

(51) Int. Cl.
*B60K 15/03* (2006.01)
*F01P 11/02* (2006.01)
*F01P 11/04* (2006.01)

(52) U.S. Cl.
CPC ..... *F01P 11/029* (2013.01); *F01P 11/04* (2013.01)

(58) Field of Classification Search
CPC ..... B60K 15/03; B60K 15/03006; B60K 15/03177; B60K 2015/03493; F01P 11/04; F01P 11/029
USPC ..... 220/612, 562
See application file for complete search history.

(56) References Cited

U.S. PATENT DOCUMENTS

| | | | | |
|---|---|---|---|---|
| 5,762,130 | A | 6/1998 | Uibel et al. | |
| 2006/0290137 | A1 | 12/2006 | Benettolo | |
| 2007/0235458 | A1 | 10/2007 | Hewkin | |
| 2016/0193913 | A1* | 7/2016 | Kataoka | B60K 15/03177 220/562 |

FOREIGN PATENT DOCUMENTS

JP 2002310377 A 10/2002

OTHER PUBLICATIONS

European Search Report for EP Application No. 16162753, dated Jul. 26, 2016 (4 pages).

* cited by examiner

*Primary Examiner* — King M Chu
(74) *Attorney, Agent, or Firm* — Greer, Burns & Crain, Ltd.

(57) ABSTRACT

An expansion tank for a motor-vehicle cooling system has an inlet port and an outlet port and is provided with a plastic shell having a container and two protruding collars, respectively at the two ports; at least one of the collars defines a seat, which is engaged by a tubular insert coaxial to the collar; elastically deformable teeth are provided for snap-coupling the tubular insert and the shell to each other and axially retaining the tubular insert in the seat.

6 Claims, 2 Drawing Sheets

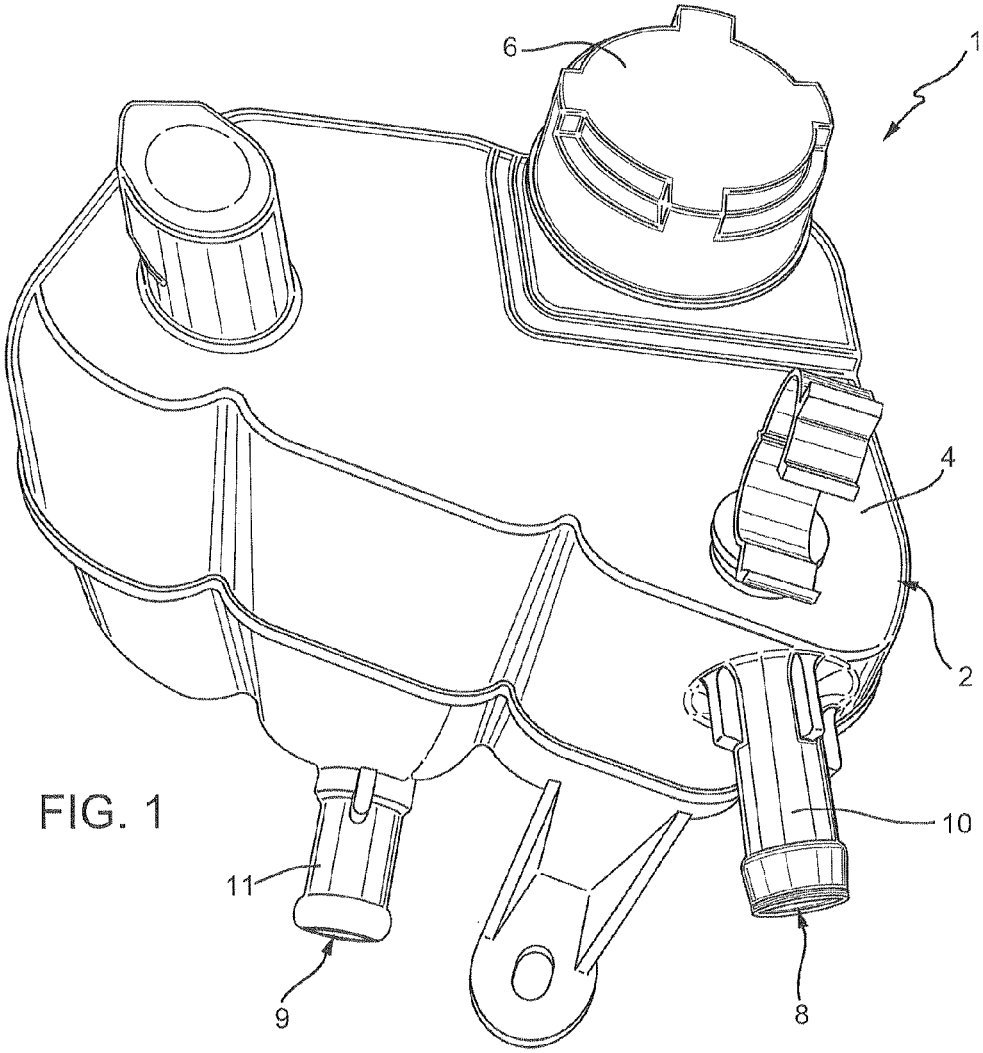
FIG. 1
FIG. 2
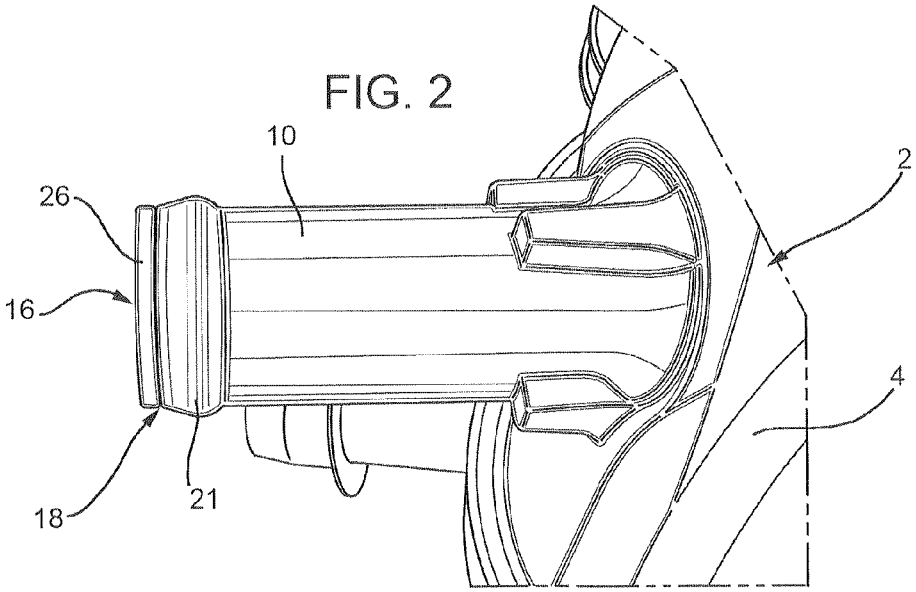

EXPANSION TANK FOR A MOTOR-VEHICLE COOLING SYSTEM

RELATED APPLICATIONS

This application claims priority from European Patent Application No. 16162753.4 filed on Mar. 30, 2016, the disclosure of which is incorporated herein by reference in its entirety.

FIELD OF THE DISCLOSURE

The present invention relates to an expansion tank for a motor-vehicle cooling system.

BACKGROUND

As already known, the combustion engine of a motor-vehicle is cooled by a cooling system that uses as cooling liquid a water/ethylene glycol mixture and has an expansion tank fastened to a support structure arranged in the engine compartment of the motor-vehicle.

The expansion tank is a container communicating with the outside through a series of inlet and outlet ports. These ports are provided at respective sleeves and collars protruding from the container, which are made of plastic material in one piece with the container. During the installation of the cooling system, corresponding ducts are then fitted on such collars to connect the inside of the container with the engine and with the radiator.

In some solutions, at the inlet port, the expansion tank is provided with a cylindrical bushing made of metallic material, generally brass, which has a radial thickness of about 0.5 mm and is inserted in the plastic collar by means of a cold driving process so as to be fastened with an interference fitting to the inner surface of the plastic collar.

The brass bushing has two different functions and objectives: shielding the plastic collar from the heat and the high temperatures of the cooling liquid coming from the engine (in particular from the engine supercharging turbine), and therefore limiting the heat exchange between the cooling liquid and the plastic collar, in order to avoid a rapid deterioration of the latter; and defining a localized stiffening at the inlet port to support the mechanical stresses, in particular due to the vibrations caused by the engine and by the motion of the motor-vehicle.

The aforesaid solution with a brass bushing, although widely used, has some drawbacks. In fact, it has been found that the plastic collar anyway deteriorates in time, despite the presence of the brass bushing.

In particular, because of the vibrations affecting the expansion tank, in time the bushing tends to slip outwards of a few millimetres from the plastic collar where it is inserted. Therefore, the innermost portion of the plastic collar lacks of reinforcement.

This event obviously weakens the plastic collar at its innermost portion. In particular, the vibrations transmitted to the expansion tank increasingly solicit this portion, which therefore tends to have micro-fractures or, even, localized ruptures in the plastic material.

Furthermore, the innermost portion of the plastic collar is no longer protected from the high temperature of the cooling liquid. It follows that, in this area, the plastic material is subject to greater thermal stresses, which therefore cause a further deterioration or in any case a faster deterioration. In particular, severe thermal stresses occur during the engine shutdown phases, since the cooling liquid ceases to circulate in the plant.

SUMMARY OF THE INVENTION

The object of the present invention is to provide an expansion tank for a motor-vehicle cooling system solving in a simple and inexpensive way the aforesaid drawbacks.

According to the present invention, an expansion tank for a motor-vehicle cooling system is manufactured as defined in claim 1.

BRIEF DESCRIPTION OF THE DRAWINGS

For a better understanding of the present invention it will be now described a preferred embodiment, purely by way of a non-limiting example, with reference to the accompanying drawings, in which:

FIG. 1 is a perspective view of a preferred embodiment of the expansion tank for a motor-vehicle cooling system according to the present invention;

FIG. 2 shows, in enlarged scale, an inlet port of the expansion tank of FIG. 1.

DETAILED DESCRIPTION

Figure 3:
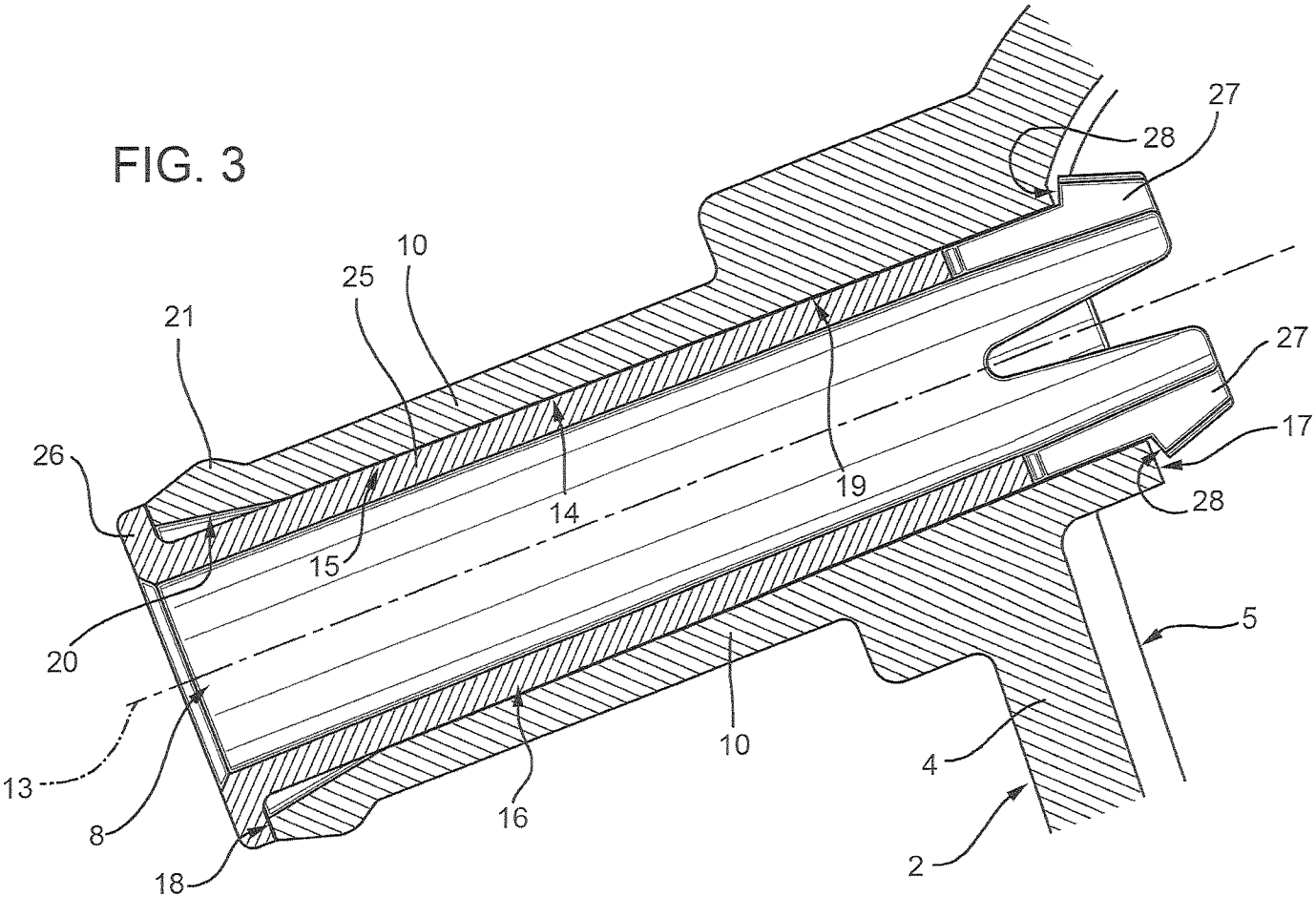
FIG. 3 shows in section the inlet port of FIG. 2.

In FIG. 1, the reference number 1 indicates an expansion tank forming part of a cooling system (not shown) which, in use, is arranged in an engine compartment of a motor-vehicle. This system provides for the circulation of a cooling liquid to remove the heat from an internal combustion engine (not shown).

The expansion tank 1 comprises a shell 2, which is made of plastic material, in a single piece or multiple pieces fixed to one another and, in turn, comprises a container 4 defining an inner cavity 5 (FIG. 3) to receive and contain the cooling liquid.

In particular, the container 4 has, at its upper end, an opening closed by a removable cap 6 to top up the level of the cooling liquid in the cavity 5. This latter communicates with the remaining part of the cooling system through an inlet port 8 and an outlet port 9 arranged at an inlet collar 10 and, respectively, at an outlet collar 11.

The collars 10, 11 are colloquially referred to as "fillers", form part of the shell 2 and protrude from the container 4. Two ducts (not shown) are fitted, in use, on the collars 10 and 11 for connecting the tank 1 to the remaining part of the cooling plant.

As shown in FIG. 3, the collar 10 protrudes along an axis 13 and has an inner surface 14 defining an axial seat 15, which is engaged by a tubular insert 16 coaxial with the collar 10 and actually defining the port 8.

At opposite axial ends, the surface 14 terminates at two shoulders indicated by the reference numbers 17 and 18, which are transverse to the axis 13. The shoulder 18 defines an outer end edge of the collar 10, while the shoulder 17 faces the inside of the tank 1 and, in particular, is arranged in the cavity 5.

Preferably, the surface 14 comprises a cylindrical zone 19 and an end zone 20, which connects the zone 19 to the shoulder 18, is tapered from the outside inwards and, for example, is formed by a conical surface guiding the axial insertion of the insert 16 in the seat 15.

Externally, the collar 10 has at least one projection 21, arranged at the shoulder 18, for holding the corresponding duct in a fixed position.

According to the present invention, the insert 16 is held in a fixed axial position relative to the collar 10 by a snap-coupling.

In particular, the insert 16 is made as a single piece and comprises a tubular portion 25, preferably cylindrical, engaging the seat 15. In particular, the outer diameter of the portion 25 is equal to the inner diameter of the zone 19, with no radial clearance and no interference.

The insert 16 further comprises a flange 26, which radially protrudes outwardly from one end of the portion 25 and axially abuts against the shoulder 18; and one or more teeth 27, which protrude from the portion 25 at the opposite end of the flange 26, have an outer diameter larger than the one of the surface 14 and define a shoulder 28 abutting against the shoulder 17, so as to axially fasten the insert 16 astride the surface 14. At the same time, the teeth 27 are radially elastically deformable toward the axis 13, thus having an outer diameter smaller than the one of the surface 14 and being able to pass the seat 15 during the axial insertion of the insert 16 in the seat 15. When the flange 26 abuts against the shoulder 17, the teeth 27 automatically return to their original undeformed position, thus axially locking the insert 16 and preventing its slipping outwards during use.

A slight axial play may be optionally provided between the shoulders 17 and 28 and/or between the flange 26 and the shoulder 18 without jeopardizing the effectiveness of the insert 16, which has a double function, namely, defining an internal stiffening of the collar 10 to support the stresses and shielding the collar 10 from the heat of the cooling liquid entering the tank 1 through the port 8.

According to an aspect of the present invention, the material of the insert 16 is a plastic material so as to have a relatively low heat conduction coefficient and to obtain an optimal elasticity and flexibility of the teeth 27.

The plastic material of the insert 16 must be selected among those commercially available in order to have a maximum operating temperature higher than the operating temperature of the cooling liquid entering the port 8. These temperatures are variable depending on the type of engine and on the type of cooling system, so that the plastic material of the insert 16 cannot be uniquely determined a priori, but must be chosen according to the specific application.

Merely by way of example, if the cooling liquid operating temperatures are relatively high (for example 125° C.) at the port 8, the use of plastic materials such as PET and PP is not appropriate, because their maximum operating temperatures are too low, but the use of plastic materials such as PA, PPS, PC is appropriate.

From the above, it is clear that the type of coupling provided to fasten the insert 16 in the seat 15 prevents the insert 16 from axially sliding out during use, and therefore guarantees the steadiness of the position of the insert 16 in time. At the same time, the assembly by axial insertion of the insert 16 in the collar 10 does not generate difficulties, as it remains virtually unchanged with respect to the known solutions with a brass bushing.

The use of a plastic material for manufacturing the insert 16, then, results in a reduction of the heat conduction to the collar 10.

A further advantage of using a plastic material consists in conferring, during its implementation, a mass pigmentation to the material of the insert 16: this pigmentation can be used as a visual identification to provide corresponding information to the users, e.g. information indicating the outer diameter of the collar 10 or of the plant on which the tank 1 must be installed.

From the above it is finally clear that the described and shown expansion tank 1 can be subject to modifications and variants which do not depart from the scope of protection of the present invention as defined in the appended claims.

In particular, the configuration and/or the arrangement of the teeth 27 may be different from those illustrated by way of example. For example, one or more elastically deformable teeth could be carried by the shell 2 and could snap-engage the tubular insert inserted in the seat 15 to prevent its axial extraction.

Finally, in alternative or in combination to what described above, a solution analogous to the insert 16 could be provided at the port 9.

What is claimed is:

1. An expansion tank for a motor-vehicle cooling system, the expansion tank having an inlet port and an outlet port, and comprising:

a plastic shell comprising:

a) a container to contain a cooling liquid;

b) at least two protruding collars at said inlet port and respectively said outlet port; at least one of said collars defining a seat extending along an axis;

at least one tubular insert engaging said seat and coaxial to the at least one of said collars;

retaining means, axially retaining said tubular insert in said seat;

wherein said retaining means comprise elastically deformable teeth snap-coupling said tubular insert and said shell to each other.

2. A tank according to claim 1, wherein said tubular insert is made of plastic material.

3. An expansion tank according to claim 1, wherein said elastically deformable teeth are part of said tubular insert.

4. An expansion tank according to claim 3, wherein said elastically deformable teeth are arranged at an axial end of said tubular insert; at the opposite axial end, said tubular insert comprising an external flange axially facing an outer end edge of the at least one of said collars.

5. A tank according to claim 1, wherein said seat is defined by a surface comprising a cylindrical zone and an end zone, which is tapered from the outside inwards.

6. A tank according to claim 5, wherein said tubular insert comprises a cylindrical portion having an outer diameter equal to the inner diameter of said cylindrical zone.

* * * * *